US012799410B2

(12) United States Patent
Van Dijk et al.

(10) Patent No.: US 12,799,410 B2
(45) Date of Patent: Nov. 17, 2026

(54) PROCESS FOR PRODUCING A LIQUID HYDROCARBON FROM RENEWABLE SOURCES

(71) Applicant: SHELL USA, INC., Houston, TX (US)

(72) Inventors: Nicolaas Van Dijk, Amsterdam (NL); Ronald Martijn De Deugd, Amsterdam (NL); Edward Julius Creyghton, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 230 days.

(21) Appl. No.: 18/709,879

(22) PCT Filed: Nov. 30, 2022

(86) PCT No.: PCT/US2022/080611

§ 371 (c)(1),
(2) Date: May 14, 2024

(87) PCT Pub. No.: WO2023/107834

PCT Pub. Date: Jun. 15, 2023

(65) Prior Publication Data

US 2025/0011663 A1 Jan. 9, 2025

(30) Foreign Application Priority Data

Dec. 7, 2021 (EP) ..... 21212771

(51) Int. Cl.
*C10G 65/08* (2006.01)

(52) U.S. Cl.
CPC ..... *C10G 65/08* (2013.01); *C10G 2300/1011* (2013.01); *C10G 2300/70* (2013.01)

(58) Field of Classification Search
CPC ..... C10G 65/08; C10G 2300/1011; C10G 2300/70; C10G 2300/1003; C10G 3/40;
(Continued)

(56) References Cited

U.S. PATENT DOCUMENTS 8,324,438 B2 12/2012 Brandvold et al.
8,329,967 B2 12/2012 Brandvold et al.
(Continued)

OTHER PUBLICATIONS

Office Action Received for European Application No. 22839964.8, Mailed on Mar. 31, 2025, 05 Pages (05 Pages of Official Copy).
(Continued)

*Primary Examiner* — Ellen M McAvoy
*Assistant Examiner* — Chantel Graham
(74) *Attorney, Agent, or Firm* — SHELL USA, INC.

(57) ABSTRACT

A process for producing a liquid hydrocarbon from renewable sources includes combining first and second liquids, where the first liquid is produced by hydrotreating a first renewable source and the second liquid is produced by hydropyrolyzing a second renewable source. The first liquid has a n-paraffin content greater than or equal to 50 wt. %, while the second liquid has an aromatic content greater than or equal to 5 wt. %. The combined liquid has a first n-paraffin content and a first aromatic content before being subjected to a hydrogenation catalyst and conditions sufficient to cause a hydrodearomatization reaction, and a hydroisomerization catalyst and conditions sufficient to cause a hydroisomerization reaction. The resulting liquid hydrocarbon has a second n-paraffin content that is less than the first n-paraffin content and a second aromatic content that is less than the first aromatic content.

13 Claims, 1 Drawing Sheet

(58) Field of Classification Search
CPC ..... C10G 3/50; C10G 45/44; C10G 45/58; C10G 65/043; C10G 65/14; C10G 1/002; Y02P 30/20
See application file for complete search history.

(56) References Cited

U.S. PATENT DOCUMENTS

| | | | | |
|---|---|---|---|---|
| 8,329,968 | B2 | 12/2012 | Brandvold et al. | |
| 2003/0106839 | A1* | 6/2003 | Coker | C10G 45/08 208/217 |
| 2008/0244962 | A1* | 10/2008 | Abhari | C10L 3/12 208/15 |
| 2010/0256428 | A1 | 10/2010 | Marker et al. | |
| 2011/0060176 | A1* | 3/2011 | Kiesslich | B01J 38/10 585/407 |
| 2016/0130509 | A1* | 5/2016 | Nousiainen | C10G 3/46 585/324 |
| 2023/0019086 | A1* | 1/2023 | Malatak | C10G 7/00 |

OTHER PUBLICATIONS

International Search Report and Written Opinion received for PCT Patent Application No. PCT/US2022/080611, mailed on Feb. 13, 2023, 08 pages.

* cited by examiner

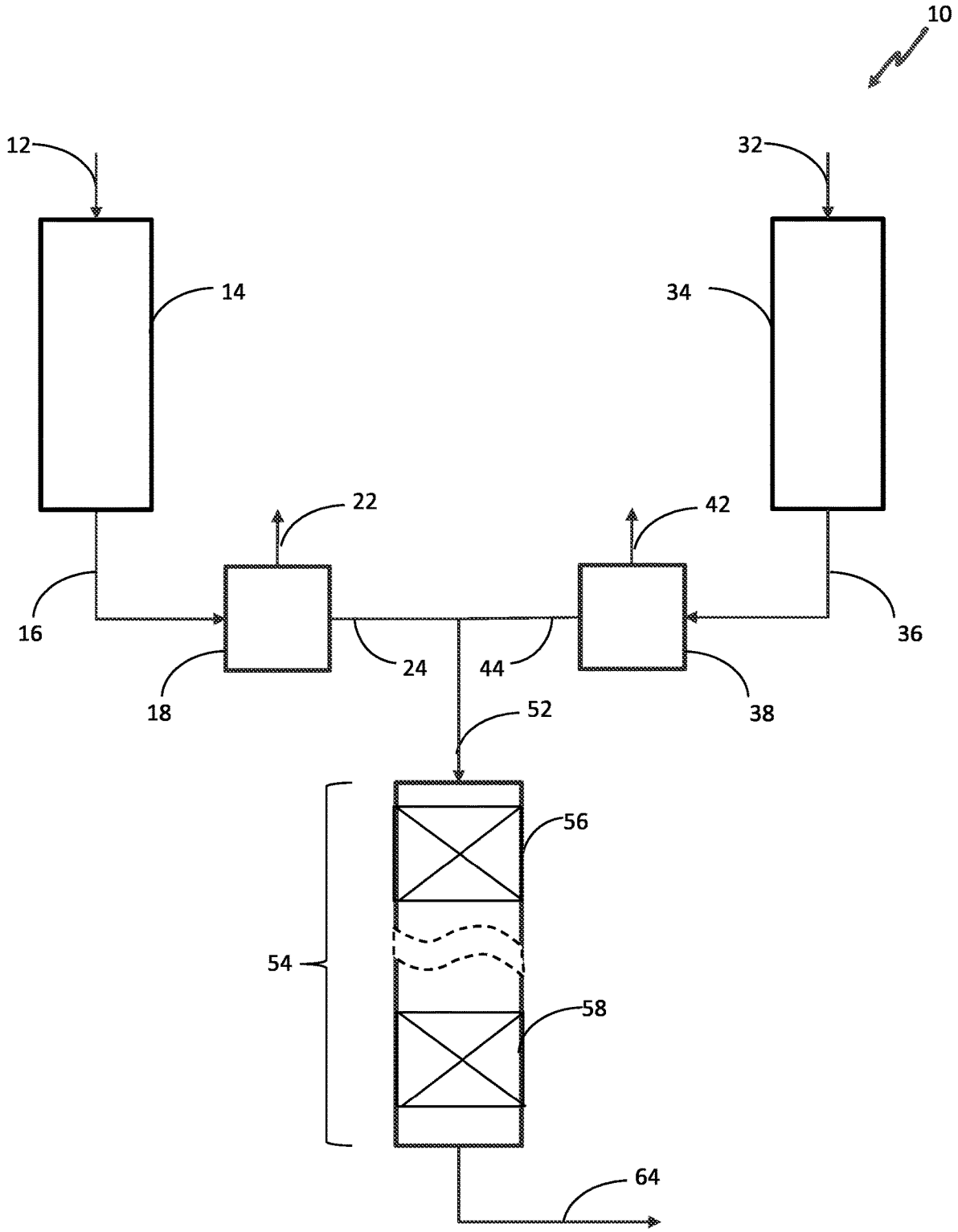
10
12
14
32
34
22
42
16
36
18
24
44
38
52
56
54
58
64

PROCESS FOR PRODUCING A LIQUID HYDROCARBON FROM RENEWABLE SOURCES

CROSS REFERENCE TO RELATED APPLICATIONS

This is a National stage application of International Application No. PCT/US2022/080611, filed 30 Nov. 2022, which claims priority of European Application No. 21212771.6 filed 7 Dec. 2021 which is incorporated herein by reference in its entirety.

FIELD OF THE INVENTION

The present invention relates to the field of producing low carbon fuel and/or chemicals from renewable sources and, in particular, to a process for co-processing liquid hydrocarbons from different treatments.

BACKGROUND OF THE INVENTION

The increased demand for energy resulting from worldwide economic growth and development has contributed to an increase in concentration of greenhouse gases in the atmosphere. This has been regarded as one of the most important challenges facing mankind in the 21st century. To mitigate the effects of greenhouse gases, efforts have been made to reduce the global carbon footprint. The capacity of the earth's system to absorb greenhouse gas emissions is already exhausted, and under the Paris climate agreement, current emissions must be fully stopped until around 2070. To realize these reductions, the world is transitioning away from solely conventional carbon-based fossil fuel energy carriers. A timely implementation of the energy transition requires multiple approaches in parallel. For example, energy conservation, improvements in energy efficiency and electrification may play a role, but also efforts to use renewable resources for the production of fuels and fuel components and/or chemical feedstocks.

For example, vegetable oils, oils obtained from algae, and animal fats are seen as new sources for low carbon fuel production. Also, deconstructed materials are seen as a potential source for low carbon renewable fuels materials, such as pyrolyzed recyclable materials or wood.

Renewable materials may comprise materials such as triglycerides with very high molecular mass and high viscosity, which means that using them directly or as a mixture in fuel bases is problematic for modem engines. On the other hand, the hydrocarbon chains that constitute, for example, triglycerides are essentially linear and their length (in terms of number of carbon atoms) is compatible with the hydrocarbons used in/as fuels. Thus, it is attractive to transform triglyceride-comprising feeds in order to obtain good quality fuel components. As well, renewable feedstocks may comprise unsaturated compounds and/or oxygenates that are unsaturated compounds.

The renewable feedstocks are therefore hydrotreated to remove oxygen, sulphur, and nitrogen. As well, where the renewable feedstock is coprocessed with petroleum-derived feedstocks, the feed is hydrotreated to remove sulphur and nitrogen.

Hydrocarbon liquids derived from biorenewable fats and oils typically have low aromatic content (e.g., ≤1 wt. %) and high n-paraffin content (e.g., ≥95 wt. %). Meanwhile, hydrocarbon liquids derived from solid biomass feedstock include cyclic compounds, such as aromatics, naphthenes and carbohydrates. Such hydrocarbon liquids have a high cyclic hydrocarbon content (e.g., ≥75% wt. %) and a low n-paraffinic content (e.g., ≤25 wt. %).

Brandvold et al. (U.S. Pat. No. 8,324,438B2, 4 Dec. 2012; U.S. Pat. No. 8,329,967B2 and U.S. Pat. No. 8,329,968B2, 11 Dec. 2012) describe a process for producing a blended fuel by generating a paraffin-rich component from a first renewable feedstock and a cyclic-rich component from a second renewable feedstock. The two components are independently processed and then blended to produce a fuel in the boiling point ranges of gasoline, aviation, and diesel fuels.

There remains a need for producing a liquid hydrocarbon, useful as a fuel component and/or a chemical, from renewable sources.

SUMMARY OF THE INVENTION

According to one aspect of the present invention, there is provided a process for producing a liquid hydrocarbon from renewable sources, comprising the steps of: providing a first liquid produced by hydrotreating a first renewable source, the first liquid having a n-paraffin content greater than or equal to 50 wt. %; providing a second liquid produced by hydropyrolyzing a second renewable source, the second liquid having an aromatic content greater than or equal to 5 wt. %, preferably greater than or equal to 10 wt. %, more preferably greater than or equal to 20 wt. %; combining the first liquid and the second liquid, the combined liquid having a first n-paraffin content and a first aromatic content; and coprocessing the combined liquid by subjecting the combined liquid to a hydrogenation catalyst and conditions sufficient to cause a hydrodearomatization reaction, and subjecting the dearomatized liquid to a hydroisomerization catalyst and conditions sufficient to cause a hydroisomerization reaction; thereby producing a liquid hydrocarbon having a second n-paraffin content that is less than the first n-paraffin content and a second aromatic content that is less than the first aromatic content.

BRIEF DESCRIPTION OF THE DRAWINGS

The process of the present invention will be better understood by referring to the following detailed description of preferred embodiments and the drawings referenced therein, in which:

The FIGURE is a flow diagram illustrating one embodiment of the present invention.

DETAILED DESCRIPTION OF THE INVENTION

The present invention provides a process for producing a liquid hydrocarbon useful as a fuel component and/or for chemical production. The process of the present invention uses a first liquid produced by hydrodeoxygenating a first renewable source and a second liquid product produced by hydropyrolyzing a second renewable source. The first and second liquids are combined to provide a combined liquid having a first n-paraffin content and a first aromatic content. The combined liquid is coprocessed by subjecting the combined liquid to a hydrogenation catalyst and conditions to cause a hydrodearomatization reaction and subjecting the dearomatized liquid to a hydroisomerization catalyst and conditions to cause a hydroisomerization reaction. The liquid hydrocarbon product has a second n-paraffin content that is less that the first n-paraffin content and a second aromatic content that is less than the first aromatic content. By reducing the n-paraffin content, the cold flow properties are improved. Meanwhile, by reducing the aromatic content, the liquid hydrocarbon meets fuel specifications relating to environmental impact. In the case of chemical production, the process of the present invention is advantageous, for example, when iso-paraffins are desirable.

As used herein, the terms "renewable feedstock", "renewable feed", and "material from renewable sources" mean a feedstock from a renewable source. A renewable source may be animal, vegetable, microbial, and/or bio-derived or mineral-derived waste materials suitable for the production of fuels, fuel components and/or chemical feedstocks.

The inventors have surprisingly discovered that by combining the first and second liquids and coprocessing the combined liquid by hydrogenation, followed by hydroisomerization, the cold flow property is synergistically improved, such that the cold flow property is improved to a higher degree than expected for hydroisomerization without first hydrogenating the combined liquid.

First Liquid

Referring to the FIGURE, a first renewable source 12 is routed to a hydrotreating reactor 14 and subjected to a hydrotreating catalyst and conditions sufficient to hydrotreat (including, without limitation, hydrodeoxygenation, hydrodenitrogenation, hydrodesulphurization, and/or hydrodemetallization) the first renewable source 12. The hydrotreated effluent 16 from the hydrotreating reactor 14 is preferably passed to a separation system 18 for separating the hydrotreated effluent 16 into at least one gas 22 and at least one liquid, at least a portion of which is used as a first liquid 24 for the process of the present invention 10. The first liquid 24 is n-paraffin rich, having an n-paraffin content greater than or equal to 50 wt. %, preferably greater than or equal to 60 wt. %, more preferably greater than or equal to 65 wt. %. The first liquid 24 has a low aromatics content, for example, less than or equal to 1 wt. %. Preferably, the first liquid has a density at 15° C. less than 845 kg/m$^3$.

In an embodiment of the present invention, a portion of the first liquid 24 may be recycled to the hydrotreating reactor 14. Alternatively, or in addition, a portion of the first liquid 24 may be provided as a quench to the hydrotreating reactor 14.

The process of the present invention is most particularly advantageous in the processing of feed streams comprising substantially 100% renewable feedstocks. However, in one embodiment of the present invention, the first renewable source 12 may be co-processed with petroleum-derived hydrocarbons. Petroleum-derived hydrocarbons include, without limitation, all fractions from petroleum crude oil, natural gas condensate, tar sands, shale oil, synthetic crude, and combinations thereof. The present invention is more particularly advantageous for a combined renewable and petroleum-derived feedstock comprising a renewable feed content in a range of from 30 to 99 wt. %. In this case, the first liquid 24 may have a lower n-paraffin content, for example, an n-paraffin content greater than or equal to 30 wt. %.

The first renewable source 12 is preferably selected from vegetable oils, algal oils, and animal fats. A preferred class of renewable materials for the first renewable source 12 are bio-renewable fats and oils comprising triglycerides, diglycerides, monoglycerides, free fatty acids, and/or fatty acid esters derived from bio-renewable fats and oils. Examples of fatty acid esters include, but are not limited to, fatty acid methyl esters and fatty acid ethyl esters. The bio-renewable fats and oils include both edible and non-edible fats and oils. Examples of bio-renewable fats and oils include, without limitation, algal oil, brown grease, camelina oil, canola oil, carinata oil, castor oil, coconut oil, colza oil, corn oil, cottonseed oil, fish oil, hempseed oil, jatropha oil, lard, linseed oil, milk fats, mustard oil, olive oil, palm oil, peanut oil, pongamia oil, rapeseed oil, sewage sludge, soy oils, soybean oil, sunflower oil, tall oil, tallow, used cooking oil, yellow grease, and combinations thereof.

The first renewable source 12 may contain impurities. Examples of such impurities include, but are not limited to, solids, iron, chloride, phosphorus, alkali metals, alkaline-earth metals, polyethylene and unsaponifiable compounds. If required, these impurities can be removed from the renewable source 12 before being introduced to the process of the present invention. Methods to remove these impurities are known to the person skilled in the art.

The hydrotreating reactor 14 may be a single-stage or multi-stage and may be comprised of a single reactor or multiple reactors. The hydrotreating reactor 14 may be operated in a slurry, fluidized bed, and/or fixed bed operation. In the case of a fixed bed operation, each reactor may have a single catalyst bed or multiple catalyst beds. The hydrotreating reactor 14 may be operated in a co-current flow, counter-current flow, or a combination thereof.

Preferably, the hydrotreating catalyst comprises sulphided catalytically active metals. Examples of suitable catalytically active metals include, without limitation, sulphided nickel, sulphided cobalt, sulphided molybdenum, sulphided tungsten, sulphided CoMo, sulphided NiMo, sulphided MoW, sulphided NiW, and combinations thereof. A catalyst bed/zone may have a mixture of two types of catalysts and/or successive beds/zones, including stacked beds, and may have the same or different catalysts and/or catalyst mixtures. In case of such sulphided hydrotreating catalyst, a sulphur source will typically be supplied to the catalyst to keep the catalyst in sulphided form during the hydroprocessing step.

The hydrotreating catalyst may be sulphided in-situ or ex-situ. In-situ sulphiding may be achieved by supplying a sulphur source, usually $H_2S$ or an $H_2S$ precursor (i.e., a compound that easily decomposes into $H_2S$ such as, for example, dimethyl disulphide, di-tert-nonyl polysulphide or di-tert-butyl polysulphide) to the hydroprocessing catalyst during operation of the process. The sulphur source may be supplied with the feed, the hydrogen stream, or separately. An alternative suitable sulphur source is a sulphur-comprising hydrocarbon stream boiling in the diesel or kerosene boiling range that is co-fed with the feedstock. In addition, added sulphur compounds in feed facilitate the control of catalyst stability and may reduce hydrogen consumption.

The hydrotreating catalyst may be used in bulk metal form or the metals may be supported on a carrier. Suitable carriers include refractory oxides, molecular sieves and combinations thereof. Examples of suitable refractory oxides include, but are not limited to, alumina, amorphous silica-alumina, titania, silica, and combinations thereof.

The hydrotreating reactor 14 is operated in the presence of hydrogen at a pressure in a range of from 1.0 MPa to 20 MPa and at a temperature in a range of from 120° C. to 410° C. Preferably, the pressure is in a range of from 2.0 MPa to 15 MPa, and the temperature is in a range of from 200° C. to 400° C., more preferably from 240° C. to 390° C., most preferably from 260° C. to 385° C. The liquid hourly space velocity (LHSV) is in a range of from 0.3 h$^{-1}$ to 5 h$^{-1}$ based on fresh feed. The total feed entering the hydrotreating reactor 14 may have approximately 50-20000 ppmw, preferably 700-8000 ppmw, most preferably 1000-5000 ppmw of sulfur, calculated as elemental sulfur. The term "total feed" is intended to denote the total of fresh feed 12 and any optional diluting agent(s) such as a product recycle. The ratio of the hydrogen gas to the first renewable source 12 (excluding diluent) supplied to the hydrotreating reactor 14 is in a range of from 200 to 10,000 normal L (at standard conditions of 0° C. and 1 atm (0.1 MPa)) per kg of the first renewable source 12, preferably from approximately 500 to 8,000 NL/kg, more preferably from approximately 800 to 3,000 NL/kg.

In one embodiment, the hydrogen may be produced, for example, without limitation, by water electrolysis. The water electrolysis process may be powered by renewable energy (such as solar photovoltaic, wind or hydroelectric power) to generate green hydrogen, nuclear energy or by non-renewable power from other sources (grey hydrogen).

The reaction catalysed in the hydrotreating reactor 14 includes, without limitation, hydrodeoxygenation, hydrodenitrogenation, hydrodesulphurization, and/or hydrodemetallization. Preferably, the catalysed reaction includes at least hydrodeoxygenation, where oxygen is removed from triglycerides, diglycerides, monoglycerides, free fatty esters, and/or fatty acid esters to produce paraffinic compounds. Preferably, the degree of hydrodeoxygenation is greater than 90%, more preferably greater than 95%.

The separation system 18 has one or more separation units including, for example, without limitation, gas/liquid separators, including hot high- and low-pressure separators, intermediate high- and low-pressure separators, cold high- and low-pressure separators, strippers, integrated strippers and combinations thereof. Integrated strippers include strippers that are integrated with hot high- and low-pressure separators, intermediate high- and low-pressure separators, cold high- and low-pressure separators. It will be understood by those skilled in the art that high-pressure separators operate at a pressure that is close to the hydrotreating reactor 14 pressure, suitably 0-10 bar (0-1 MPa) below the reactor outlet pressure, while a low-pressure separator is operated at a pressure that is lower than a preceding reactor in the hydrotreating reactor 14 pressure or a preceding high-pressure separator, suitably 0-15 barg (0-1.5 MPag). Similarly, it will be understood by those skilled in the art that hot means that the hot-separator is operated at a temperature that is close to a preceding reactor in the hydrotreating reactor 14 temperature, suitably sufficiently above water dew point (e.g., ≥20° C., preferably ≥10° C., above the water dew point) and sufficiently greater than salt deposition temperatures (e.g., ≥20° C., preferably ≥10° C., above the salt deposition temperature), while intermediate- and cold-separators are at a reduced temperature relative to the preceding hydrotreating reactor 14. For example, a cold-separator is suitably operated at a temperature that can be achieved via an air cooler. An intermediate temperature will be understood to mean any temperature between the temperature of a hot- or cold-separator.

In addition, the separation system 18 may include one or more treating units including, for example, without limitation, a membrane separation unit, an amine scrubber, a pressure swing adsorption (PSA) unit, a caustic wash, and combinations thereof, for treating the gas 22. The treating units are preferably selected to separate desired gas phase molecules. For example, an amine scrubber is used to selectively separate $H_2S$ and/or carbon oxides from $H_2$ and/or hydrocarbons. As another example, a PSA unit may be used to purify a hydrogen stream for recycling to a stripper and/or a reactor in the hydrotreating reactor 14.

A portion of the gas 22 may be sent to a separation, reforming, and water-gas shift section where hydrogen is produced from the light hydrocarbon gases. A fuel gas stream may be recovered as a by-product of this process. The produced hydrogen may be re-used in the hydrotreating reactor 14, the pyrolysis unit 34, the hydroisomerization zone and/or the hydrodearomatization zone.

The separation system 18 is simplified in the drawings for ease of discussion. It will be understood by those skilled in the art that the same or different separation units and/or the treating units may be provided between and/or after catalyst zones in the hydrotreating reactor 14 and between and/or after components of any work-up section and/or gas-handling section (not shown).

At least a portion of the liquid hydrocarbon from the separation system 18 is the first liquid 24 that is combined with the second liquid 44.

Second Liquid

A second renewable source 32 is routed to a hydropyrolysis unit 34. Preferably, the second renewable source 32 is provided as a solid feedstock. The hydropyrolysis unit 34 includes a hydropyrolysis reactor and a hydroconversion reactor. The hydropyrolysis reactor includes one or more deoxygenation catalysts to generate a partially deoxygenated hydropyrolysis product. At least a portion of the partially deoxygenated hydropyrolysis product is routed to the hydroconversion reactor having one or more hydroconversion catalysts wherein the partially deoxygenated hydropyrolysis product is converted to a substantially fully deoxygenated hydrocarbon product. The effluent from the hydropyrolysis unit 34 is preferably passed to a separation system 38 for separating the effluent into at least one gas 42 and at least one liquid, at least a portion of which is used as a second liquid 44 for the process of the present invention 10. The second liquid 44 is generally dense (e.g., a density at 15° C. greater than or equal to 845 kg/m$^3$), and has a high cyclic hydrocarbon content, preferably greater than or equal to 75 wt. %) and a low n-paraffin content, preferably less than or equal to 25 wt. %. The aromatic content of the second liquid 44 is greater than or equal to 5 wt. %, preferably greater than or equal to 10 wt. %, more preferably greater than or equal to 20 wt. %.

The second renewable source 32 is preferably selected from a residual waste feedstock and/or a biomass feedstock containing lignin, lignocellulosic, cellulosic, hemicellulosic material. Lignocellulosic material may include a mixture of lignin, cellulose and hemicelluloses in any proportion, as well as contains ash and moisture. Such material is more difficult to convert into fungible liquid hydrocarbon products than cellulosic and hemicellulosic material. Suitable lignocellulose-containing biomass includes woody biomass and agricultural and forestry products and residues (whole harvest energy crops, round wood, forest slash, bamboo, sawdust, bagasse, sugarcane tops and trash, cotton stalks, corn stover, corn cobs, castor stalks, Jatropha whole harvest, Jatropha trimmings, de-oiled cakes of palm, castor and Jatropha, coconut shells, residues derived from edible nut production and mixtures thereof), and municipal solid wastes containing lignocellulosic material. The municipal solid waste may include any combination of lignocellulosic material (yard trimmings, pressure-treated wood such as fence posts, plywood), discarded paper and cardboard and waste plastics, along with refractories such as glass, metal. Prior to pyrolysis, municipal solid waste may be optionally converted into pellet or briquette form. The pellets or briquettes are commonly referred to as Refuse Derived Fuel in the industry. Residual waste feedstocks are those having mainly waste plastics. In a preferred embodiment, woody biomass is used as the source of the biomass.

The second renewable source 32 is preferably provided to the hydropyrolysis reactor as a solid together with hydrogen. The hydropyrolysis reactor contains a deoxygenation catalyst that facilitates partial deoxygenation of the second renewable source 32. The effluent from the hydropyrolysis reactor contains char, partially deoxygenated products of hydropyrolysis, light gases ($C_1$-$C_3$ gases, CO, $CO_2$, and $H_2$), water vapor and catalyst fines. The partially deoxygenated product has an oxygen content ≤70 wt. %, preferably ≤50 wt. %, more preferably ≤30 wt. %, relative to the oxygen content of the second renewable source 32. The hydropyrolysis reactor may be a fluidized bed reactor, fixed-bed reactor, or any other suitable reactor. In embodiments in which the hydropyrolysis reactor is a fluidized bed reactor, the fluidization velocity, catalyst particle size and bulk density and solid particle size and bulk density are selected such that the deoxygenation catalyst remains in the bubbling fluidized bed, while the char produced is entrained with the partially deoxygenated products. The hydropyrolysis reactor preferably employs rapid heating of the second renewable source 32 such that a residence time of the pyrolysis vapors in the hydropyrolysis reactor is preferably ≤1 minute, more preferably ≤30 seconds and, most preferably ≤10 seconds.

The second renewable source 32 may be provided to the hydropyrolysis reactor in the form of loose biomass particles having a majority of particles preferably ≤3.5 mm in size or in the form of a biomass/liquid slurry.

The hydropyrolysis reactor is operated at a temperature in a range of from 350° C. to 600° C. and a pressure in a range of from 0.1 MPa to 6 MPa (1-60 bar). The heating rate of the second renewable source 32 is preferably greater than or equal to 100 $W/m^2$. The weight hourly space velocity (WHSV) for the hydropyrolysis reactor is in a range of from 0.2 $h^{-1}$ to 10 $h^{-1}$, preferably in a range of from 0.3 $h^{-1}$ to 3 $h^{-1}$.

Any deoxygenation catalyst suitable for use in the temperature range of the hydropyrolysis reactor may be used. Preferably, the deoxygenation catalyst is selected from sulfided catalysts having one or more metals from the group consisting of Ni, Co, Mo or W supported on a metal oxide. Suitable metal combinations include sulfided NiMo, sulfided CoMo, sulfided NiW, sulfided CoW and sulfided ternary metal systems having any 3 metals from the family consisting of Ni, Co, Mo and W. Monometallic catalysts such as sulfided Mo, sulfided Ni and sulfided W are also suitable for use. Metal combinations for the deoxygenation catalyst used in accordance with certain embodiments of the present disclosure include sulfided NiMo and sulfided CoMo. Supports for the sulfided metal catalysts include metal oxides such as, but not limited to, alumina, silica, titania, ceria and zirconia. Binary oxides such as silica-alumina, silica-titania and ceria-zirconia may also be used. Preferably, the supports include alumina, silica and titania. In certain embodiments, the support contains recycled, regenerated and revitalized fines of spent hydrotreating catalysts (e.g., fines of CoMo on oxidic supports, NiMo on oxidic supports and fines of hydrocracking catalysts containing NiW on a mixture of oxidic carriers and zeolites). Total metal loadings on the deoxygenation catalyst are preferably in a range of from 1.5 wt. % to 50 wt. % expressed as a weight percentage of calcined deoxygenation catalyst in oxidic form (e.g., weight percentage of Ni (as NiO) and Mo (as $MoO_3$) on calcined oxidized NiMo on alumina support). Additional elements such as phosphorous may be incorporated into the deoxygenation catalyst to improve the dispersion of the metal.

Effluent from the hydropyrolysis reactor includes char, ash and catalyst fines entrained with the partially deoxygenated hydrolysis product. Therefore, between the hydropyrolysis and hydroconversion reactors of the pyrolysis unit 34, char and catalyst fines are removed from the product. Any ash present may also be removed at this stage.

Accordingly, the pyrolysis unit 34 may include solid separation equipment to mitigate the entrainment of solid particles above a certain particle size. Char, catalyst fines and/or ash may be removed by cyclone separation, filtering, electrostatic precipitation, inertial separation, magnetic separation, or any other suitable solid separation technique and combinations thereof.

Char, catalyst fines and/or ash may also be removed by bubbling effluent from the hydropyrolysis reactor through a re-circulating liquid.

The second renewable feedstock 32 may contain impurities such as, but not limited to, sodium, potassium, calcium, and phosphorous compounds. These impurities may poison the hydroconversion catalyst used in the hydroconversion reactor of the pyrolysis unit 34. Preferably, these metals are removed with the char and ash.

Following removal of char, catalyst fines and/or ash, the partially deoxygenated hydropyrolysis effluent from the hydropyrolysis reactor is fed to the hydroconversion reactor. The hydroconversion reactor is operated at a temperature in a range of from 300° C. to 600° C. and a pressure in a range of from 0.1 MPa to 6 MPa. The WHSV for the hydroconversion reaction is in a range of from 0.1 $h^{-1}$ to 2 $h^{-1}$. The hydroconversion reactor may be a fixed bed reactor or a fluidized bed reactor. In the hydroconversion reactor, partially deoxygenated product from the pyrolysis reactor is fully deoxygenated wherein ≥98 wt. %, preferably ≥99 wt. %, more preferably ≥99.9 wt. % of the oxygen present in the original second renewable source 32 has been removed. The effluent from the hydroconversion reactor contains light gaseous hydrocarbons, such as methane, ethane, ethylene, propane and propylene, naphtha range hydrocarbons, middle-distillate range hydrocarbons, hydrocarbons boiling above 370° C. (based on ASTM D86), hydrogen and by-products of the hydroconversion reactions such as $H_2O$, $H_2S$, $NH_3$, CO and $CO_2$.

In one embodiment, the hydrogen for the hydropyrolysis and/or hydroconversion reactions may be produced, for example, without limitation, by water electrolysis. The water electrolysis process may be powered by renewable energy (such as solar photovoltaic, wind or hydroelectric power) to generate green hydrogen, nuclear energy or by non-renewable power from other sources (grey hydrogen).

The hydroconversion catalyst used in the hydroconversion reactor includes any suitable hydroconversion catalyst having a desired activity in the temperature range of the disclosed hydroconversion process. For example, the hydroconversion catalyst is selected from sulfided catalysts having one or more metals from the group consisting of Ni, Co, Mo or W supported on a metal oxide. Suitable metal combinations include sulfided NiMo, sulfided CoMo, sulfided NiW, sulfided CoW and sulfided ternary metal systems having any three metals from the family consisting of Ni, Co, Mo and W. Catalysts such as sulfided Mo, sulfided Ni and sulfided W are also suitable for use. The metal oxide supports for the sulfided metal catalysts include, but are not limited to, alumina, silica, titania, ceria, zirconia, as well as binary oxides such as silica-alumina, silica-titania and ceria-zirconia. Preferred supports include alumina, silica and titania. The support may optionally contain regenerated and revitalized fines of spent hydrotreating catalysts (e.g., fines of CoMo on oxidic supports, NiMo on oxidic supports and fines of hydrocracking catalysts containing NiW on a mixture of oxidic carriers and zeolites). Total metal loadings on the catalyst are in a range of from 5 wt. % to 35 wt. % (expressed as a weight percentage of calcined catalyst in oxidic form, e.g., weight percentage of nickel (as NiO) and molybdenum (as $MoO_3$) on calcined oxidized NiMo on alumina catalyst). Additional elements such as phosphorous may be incorporated into the catalyst to improve the dispersion of the metal. Metals can be introduced on the support by impregnation or co-mulling or a combination of both techniques.

The hydroconversion catalyst used in the hydroconversion reactor may be, in composition, the same as or different to the deoxygenation catalyst used in the hydropyrolysis reactor. In one embodiment, the hydropyrolysis catalyst includes sulfided CoMo on alumina support and the hydroconversion catalyst includes sulfided NiMo on alumina support.

The effluent from the hydroconversion reactor is passed to a separation system 38, which preferably includes a condenser for condensing the hydrocarbon product. A gas-liquid separator is preferably used to provide a liquid phase product having substantially fully deoxygenated hydrocarbon liquid and aqueous material. Any suitable phase separation technique may be used to separate and remove the aqueous material from the substantially fully deoxygenated hydrocarbon liquid.

In addition, the separation system 38 may include one or more treating units for treating the gas 42, for example, as described for the separation system 18. A portion of the gas 22, 42 may be sent to a separation, reforming and water-gas shift section where hydrogen is produced from the light hydrocarbon gases. A fuel gas stream may be recovered as a by-product of this process. The produced hydrogen may be re-used in the hydrotreating reactor 14, the pyrolysis unit 34, the hydroisomerization zone and/or the hydrodearomatization zone.

The separation system 38 is simplified in the drawings for ease of discussion. It will be understood by those skilled in the art that the same or different separation units and/or the treating units may be provided between and/or after the hydropyrolysis reactor and hydroconversion reactor and between and/or after components of any work-up section and/or gas-handling section (not shown).

At least a portion of the liquid hydrocarbon from the separation system 38 is the second liquid 44 that is combined with the first liquid 24.

Combining First and Second Liquids

In accordance with the present invention 10, the first liquid 24 and the second liquid 44 are combined. As noted above, the first liquid 24 is n-paraffin rich, having an n-paraffin content greater than or equal to 50 wt. %, preferably greater than or equal to 60 wt. %, more preferably greater than or equal to 65 wt. %. The first liquid 24 has a low aromatics content, for example, less than or equal to 1 wt. %. Also as noted above, the second liquid 44 generally has a relatively high density (e.g., a density at 15° C. greater than or equal to 845 kg/m$^3$) and has a high cyclic hydrocarbon content, for example, greater than or equal to 75 wt. % and a low n-paraffin content, for example, less than or equal to 25 wt. %. The aromatic content of the second liquid 44 is greater than or equal to 5 wt. %, preferably greater than or equal to 10 wt. %, more preferably greater than or equal to 20 wt. %.

The first liquid 24 and the second liquid 44 may be combined by mixing, blending, co-feeding, feeding independently to the same reactor, and combinations thereof. For simplicity, the combined liquid 52 is illustrated in the FIGURE as having been combined prior to the reactor. However, it will be understood that the first and second liquids 24, 44 may be fed independently to the reactor and combined by a reactor internal (not shown).

The amount of first and second liquids 24, 44 in the combined liquid 52 is preferably determined by the composition of the first liquid 24, the composition of the second liquid 44, and/or the desired specification of the product 64. Preferably, the combined liquid 52 is comprised of from about 30 to 95 vol. % of the first liquid 24 and from about 5 to 70 vol. %, of the second liquid 44. More preferably, the combined liquid 52 is comprised of from about 40 to 90 vol. % of the first liquid 24 and from about 10 to 60 vol. % of the second liquid 44. Most preferably, the combined liquid 52 is comprised of from about 50 to 80 vol. % of the first liquid 24 and from about 20 to 50 vol. % of the second liquid 44.

The combined liquid 52 has a first n-paraffin content and a first aromatic content. It will be understood that the first n-paraffin content and the first aromatic content will be a function of the relative amounts of the first and second liquids 24, 44. Preferably, the first n-paraffin content of the combined liquid 52 is in a range of from 35 to 90 wt. %. Preferably, the first aromatic content of the combined liquid 52 is in a range of from 6 to 40 wt. %.

Another parameter to consider in the relative proportions of the first and second liquids 24, 44 is the desired density of the product 64. Preferably, the density of the liquid hydrocarbon produced in accordance with the present invention is in a range of from 730 to 900 kg/m$^3$, more preferably in a range of from 740 to 850 kg/m$^3$ measured at 15° C.

The first liquid 24 may be produced at the same site as the second liquid 44. Alternatively, the first liquid 24 and the second liquid 44 may be produced at different sites and transported by land or sea and/or by pipeline to a common site. The coprocessing step may be conducted at the same site as production of one or both of the first and second liquids 24, 44. Alternatively, the coprocessing step may be conducted at a different site. Preferably, the coprocessing step is conducted at the same site where at least the first liquid 24 is produced.

Coprocessing

In accordance with the present invention 10, the combined liquid 52 is coprocessed in coprocessing zone 54 to cause dearomatization and isomerization. In accordance with the present invention, the isomerization step follows the hydrogenation step so that the hydroisomerization catalyst is not overwhelmed by unsaturated rings in the second liquid 44.

The coprocessing zone 54 includes a hydrogenation zone 56 and a hydroisomerization zone 58. The dashed lines in the coprocessing zone 54 are provided to indicate that the hydrogenation zone 56 and the hydroisomerization zone 58 may be provided in the same reactor or separate reactors. In a preferred embodiment, the hydrogenation zone 56 and the hydroisomerization zone 58 are in a stacked bed relationship. Preferably, the hydrogenation zone and hydroisomerization zone have fixed-bed catalysts and operate in a co-current trickle flow.

The hydrogenation zone 56 is provided with a hydrogenation catalyst and is operated at conditions sufficient to cause a hydrodearomatization reaction. In this way, at least a portion of the aromatic rings in the second liquid 44 are converted to saturated rings. Further, at least a portion of the olefinic compounds are converted to paraffinic compounds.

The hydrogenation catalyst may be any suitable catalyst composition known to those skilled in the art. Preferably, the hydrogenation catalyst comprises a Group VIII metal on an amorphous support. Preferred amorphous supports are oxide supports, preferably alumina, zirconia, silica, amorphous silica-alumina, and combinations thereof. Preferably, the Group VIII metal is selected from the group consisting of platinum, palladium, nickel, and combinations thereof.

The hydrogenation zone 56 is operated in the presence of hydrogen at a pressure in a range of from 1 MPa to 30 MPa and at a temperature in a range of from 150° C. to 400° C. Preferably, the pressure is in a range of from 2 MPa to 17 MPa, and the temperature is in a range of from 200° C. to 360° C. The LHSV is in a range of from 0.2 $h^{-1}$ to 4 $h^{-1}$ based on fresh feed. The ratio of the hydrogen gas to the combined liquid 52 supplied to the hydrogenation zone 56 is in a range of from 100 to 1500 normal L (at standard conditions of 0° C. and 1 atm (0.1 MPa)) per kg of the combined liquid 52.

The effluent from the hydrogenation zone 56 passes to the hydroisomerization zone 58 provided with a hydroisomerization catalyst. The hydroisomerization zone 58 is operated at conditions sufficient to cause a hydroisomerization reaction. In this way, n-paraffins in the first liquid 24 are converted to iso-paraffins.

The hydroisomerization catalyst may be any suitable catalyst composition known to those skilled in the art. Preferably, the hydroisomerization catalyst comprises a Group VIII metal and a zeolitic material. The hydroisomerization catalyst may further comprise a binder, such as, without limitation, silica, alumina, silica-alumina, and combinations thereof. Preferably, the Group VIII metal is selected from the group consisting of platinum, palladium, nickel, and combinations thereof. When the Group VIII metal is Ni, the hydroisomerization preferably includes a Group VI metal, preferably Mo or W.

The zeolitic material is preferably selected from the group consisting of Beta, COK-7, EU-1, EU-2, EU-11, IZM-1, MCM-22, NU-10, ZSM-5, ZSM-12, ZSM-22, ZSM-23, ZSM-30, ZSM-35, ZSM-48, ZSM-50, ZSM-57, and combinations thereof.

The hydroisomerization zone 58 is operated in the presence of hydrogen at a pressure in a range of from 1 MPa to 30 MPa and at a temperature in a range of from 150° C. to 400° C. Preferably, the pressure is in a range of from 2 MPa to 17 MPa, and the temperature is in a range of from 200° C. to 360° C. The LHSV is in a range of from 0.2 $h^{-1}$ to 4 $h^{-1}$ based on fresh feed. The ratio of the hydrogen gas to the combined liquid 52 supplied to the hydroisomerization zone 58 is in a range of from 100 to 1500 normal L (at standard conditions of 0° C. and 1 atm (0.1 MPa)) per kg of the combined liquid 52.

In one embodiment, the hydrogen provided to the coprocessing zone 54 may be produced, for example, without limitation, by water electrolysis. The water electrolysis process may be powered by renewable energy (such as solar photovoltaic, wind or hydroelectric power) to generate green hydrogen, nuclear energy or by non-renewable power from other sources (grey hydrogen).

The product 64 from the coprocessing zone 54 has a second n-paraffin content and a second aromatic content. Preferably, the n-paraffin content of the product 64 is in a range of from 1 to 25 wt. %, more preferably in a range of from 1 to 20 wt. %, even more preferably in a range of from 1 to 10 wt. %. The targeted n-paraffin content may be selected, for example, on the desired cloud point specification for a desired fuel product/component. Preferably, the aromatic content of the product 64 is in a range of from 0 to 4 wt. %.

The product 64 may be further processed in a work-up section (not shown), for example, to fractionate into desired product fractions (e.g., naphtha, light diesel, gasoil, heavy diesel, kerosene boiling point ranges).

EXAMPLES

The following non-limiting examples of embodiments of the method of the present invention as claimed herein are provided for illustrative purposes only.

Example 1

In a reactor, two catalyst beds were placed in a stacked bed configuration: 15 mL of a hydrogenation catalyst comprising 0.3 wt. % Pt and 0.5 wt. % Pd on a support of 88 wt. % amorphous silica alumina and 12 wt. % zirconia oxide, was placed above 15 mL of a hydroisomerisation catalyst comprising 0.7 wt. % Pt on a carrier comprising 75 wt. % silica and 25 wt. % zeolite ZSM-12. Both catalyst beds were 1:1.5 diluted with 0.05 mm diameter silicon carbide particles. The silicon carbide particles were applied to mitigate reactor wall effects which could disturb the uniform liquid distribution over the catalyst bed cross section.

The temperature of each bed was independently controlled by means of an oven. The first catalyst bed was operated at 320° C., while the second catalyst bed was operated at 335° C. A combined liquid consisting of 75 wt. % of a first liquid and 25 wt. % of a second liquid was supplied to the top bed at a WHSV of 1.0 g fresh combined liquid per mL hydroisomerisation catalyst per hour. The first liquid was produced by deoxygenating soybean oil, while the second liquid was produced by hydropyrolysis of a commercially available feedstock comprising softwood sawdust and shavings from Marth Wood Shavings Supply, Inc. A gas stream comprising 100 vol % hydrogen was supplied to the top bed at a gas-to-oil ratio of 500 NL/kg. The total pressure at the reactor outlet was 73 barg (7.3 MPag).

The degree of conversion of the feedstock blend was determined in multiple ways. The hydrocarbon liquid was analyzed using two-dimensional gas chromatography to determine the molecular composition of the hydrocarbon product in terms of n-paraffinic, i-paraffinic, naphthenic and aromatic species, while the improvement of cold flow properties and density were measured using the ASTM D2500 and ASTM D4052 methods.

Prior to hydrogenation and hydroisomerization, the combined liquid had a cold flow property, measured as cloud point, of 21° C. After hydrogenation and hydroisomerization, the cloud point was reduced to −36° C., an improvement of 57 Celsius degrees.

The gaseous effluent was analyzed using gas chromatography.

The results as measured by two-dimensional gas chromatography are shown in percent weight in Table 1.

TABLE 1

| Analysis | First Liquid | Second Liquid | Example 1 Effluent |
|---|---|---|---|
| n-Paraffin | 97.0 | 11.7 | 5.1 |
| Compounds (wt. %) | | | |
| i-Paraffin | 1.3 | 2.4 | 73.4 |

TABLE 1-continued

| Analysis | First Liquid | Second Liquid | Example 1 Effluent |
|---|---|---|---|
| Compounds (wt. %) | | | |
| Aromatic | 0 | 62.3 | 0 |
| Compounds (wt. %) | | | |
| Naphthenic | 1.2 | 22.8 | 17.9 |
| Compounds (wt. %) | | | |
| Lights* (wt. %) | 0 | 0.4 | 3.4 |
| Heavies** (wt. %) | 0.5 | 0.4 | 0.2 |
| Density (kg/m$^3$) measured at 15° C. | 0.7897 | 0.9296 | 0.7894 |

*$C_1$-$C_6$ compounds
**Boiling point ≥400° C.

Comparative Example 2

Example 1 was repeated with the exception that the temperature of the first catalyst bed was lowered to 100° C. When operated at 100° C., the catalyst in the first catalyst bed was not active, which means that the combined liquid was supplied to the second catalyst bed without prior hydrogenation.

The cloud point deteriorated from −36° C. to −26° C., as compared to Example 1. The deterioration of the cold flow properties cannot be explained by the additional catalyst bed utilized in the first case, as operation of only the first catalyst bed at 320° C., while bypassing the second catalyst bed, showed only a minor improvement of 2 Celsius degrees.

It is generally understood by those skilled in the art that cold flow properties are improved by hydroisomerization. The inventors surprisingly discovered a synergistic improvement in cold flow properties by subjecting the combined liquid to a first hydrogenation reaction and a subsequent hydroisomerization reaction.

As shown above, when the combined liquid was subjected to only a hydrogenation reaction, no substantial improvement in cold flow property was found. When the combined liquid was subjected to only a hydroisomerization reaction, the cold flow property was improved by 47 Celsius degrees, based on the cloud point of the combined liquid before processing. However, the inventors surprisingly discovered that subjecting the combined liquid to hydrogenation and then hydroisomerization resulted in a 57 Celsius degree improvement in cloud point.

While the embodiments are described with reference to various implementations and exploitations, it will be understood that these embodiments are illustrative and that the scope of the inventive subject matter is not limited to them. Many variations, modifications, additions and improvements are possible. Various combinations of the techniques provided herein may be used.

We claim:

1. A process for producing a liquid hydrocarbon from renewable sources, comprising the steps of:

providing a first liquid produced by hydrotreating a first renewable source selected from the group consisting of vegetable oils, algal oils, and animal fats, and combinations thereof, the first liquid having a n-paraffin content greater than or equal to 50 wt. %;

providing a second liquid produced by hydropyrolyzing a second renewable source selected from the group consisting of lignin, lignocellulosic material, cellulosic material, hemicellulosic material, waste plastic, municipal waste, and combinations thereof, the second liquid having an aromatic content greater than or equal to 5 wt. %;

combining the first liquid and the second liquid, the combined liquid having a first n-paraffin content and a first aromatic content; and coprocessing the combined liquid by subjecting the combined liquid to a hydrogenation catalyst and conditions to cause a hydrodearomatization reaction, and subjecting the dearomatized liquid to a hydroisomerization catalyst and conditions to cause a hydroisomerization reaction;

thereby producing a liquid hydrocarbon having a second n-paraffin content that is less than the first n-paraffin content and a second aromatic content that is less than the first aromatic content.

2. The process of claim 1, wherein the hydrogenation catalyst is in a stacked bed above the hydroisomerization catalyst.

3. The process of claim 1, wherein the density of the liquid hydrocarbon is in a range of from 740 to 900 kg/m3.

4. The process of claim 1, wherein the first n-paraffin content is in a range of from 35 to 90 wt. %, and the second n-paraffin content is in a range of from 1 to 25 wt. %.

5. The process of claim 1, wherein the first aromatic content is in a range of from 6 to 40 wt. %, and the second aromatic content is in a range of from 0 to 4 wt. %.

6. The process of claim 1, wherein the hydrogenation catalyst is a Group VIII metal on an amorphous support.

7. The process of claim 1, wherein the hydroisomerization catalyst comprises a Group VIII metal and a zeolitic material.

8. The process of claim 1, wherein the combined liquid is comprised of from about 30 to 95 vol. % of the first liquid and from about 5 to 70 vol. % of the second liquid.

9. The process of claim 1, wherein the combining step is conducted by mixing, blending, co-feeding, feeding independently to the same reactor, and combinations thereof.

10. The process of claim 1, wherein the second liquid has an aromatic content greater than or equal to 10 wt. %.

11. The process of claim 1, wherein the second liquid has an aromatic content greater than or equal to 20 wt. %.

12. The process of claim 1, wherein the combined liquid is comprised of from about 40 to 90 vol. % of the first liquid and from about 10 to 60 vol. % of the second liquid.

13. The process of claim 1, wherein the combined liquid is comprised of from about 50 to 80 vol. % of the first liquid and from about 20 to 50 vol. % of the second liquid.

* * * * *